US005669750A

United States Patent [19]

Vieselmeyer

[11] Patent Number: 5,669,750

[45] Date of Patent: Sep. 23, 1997

[54] LOADER ATTACHMENT

[76] Inventor: Lee R. Vieselmeyer, P.O. Box 36, Davenport, Nebr. 68335

[21] Appl. No.: 684,577

[22] Filed: Jul. 19, 1996

[51] Int. Cl.[6] ..... B66C 23/00

[52] U.S. Cl. ..... 414/722; 414/664; 414/641; 187/237

[58] Field of Search ..... 414/685, 641, 414/643, 667, 668, 671, 664, 722; 187/237, 222

[56] References Cited

U.S. PATENT DOCUMENTS

| | | | |
|---|---|---|---|
| D. 244,439 | 5/1977 | Carr et al. | D12/5 |
| D. 327,356 | 6/1992 | Laatsch | D34/34 |
| D. 346,259 | 4/1994 | Laatsch | D34/34 |
| 3,203,568 | 8/1965 | Quayle | 187/237 X |
| 3,342,361 | 9/1967 | Melin | 414/667 |
| 4,084,715 | 4/1978 | Stedman | 214/560 |
| 4,213,624 | 7/1980 | Sanders | 280/43.12 |
| 4,248,754 | 2/1981 | Teti | 414/685 |
| 4,280,781 | 7/1981 | Bodin | 414/671 |
| 4,335,992 | 6/1982 | Reeves | 414/667 |
| 4,381,166 | 4/1983 | Smart | 414/685 |
| 4,392,772 | 7/1983 | Reeves | 414/667 |
| 4,402,645 | 9/1983 | Broderick et al. | 414/664 X |
| 4,415,302 | 11/1983 | Brouwer et al. | 414/417 |
| 4,692,085 | 9/1987 | Parsons | 414/633 |
| 4,902,190 | 2/1990 | House | 414/667 |
| 5,190,436 | 3/1993 | Sorlie | 414/667 |
| 5,338,148 | 8/1994 | Ronnblom | 414/667 |
| 5,374,156 | 12/1994 | Simpson et al. | 414/667 |

*Primary Examiner*—Donald W. Underwood
*Attorney, Agent, or Firm*—Zarley, McKee, Thomte, Voorhees & Sease; Mark D. Frederiksen

[57] ABSTRACT

A loader attachment includes a frame with a pair of arms pivotally connected thereto and depending therefrom. A tine is pivotally mounted at the lower end of each arm, and projects forwardly from each arm. Hydraulic cylinders are mounted between the frame and the arms to selectively pivot the arms inwardly towards one another and outwardly away from one another. A parallelogram linkage is provided on each arm to maintain the orientation of the tine on the arm as each arm is pivoted. A drive linkage interconnects the two parallelogram linkages such that the tines maintain an orientation relative to one another as the arms are pivoted. A hydraulic cylinder is connected between the frame and the drive linkage to permit selective rotation of the tines in opposing directions on the lower ends of the arms.

7 Claims, 5 Drawing Sheets

LOADER ATTACHMENT

TECHNICAL FIELD

The present invention relates generally to attachments used on loading vehicles, and more particularly to a hydraulically operated pallet fork having tines which are rotatable to maintain a predetermined orientation relative to one another as they are spread apart or brought together.

BACKGROUND OF THE INVENTION

In nursery and gardening work, transportation of trees, large plants, large rocks and the like, from the nursery to a planting site generally require the utilization of a loading vehicle. The loading vehicle must be capable of transporting a tree without damaging the ball roots and earth at the base of the tree. Although specialized loading vehicles have been used for this purpose, they are not generally cost effective for any but the largest operations, because of their highly specialized and limited functions. Tree planting attachments for conventional loading vehicles have also proven unsatisfactory for a number of reasons. Some of the devices, like the special loading vehicles, are far too complex and expensive for general nursery use. Others, although less expensive, have proven to be awkward to attach to a lifting vehicle or are incapable of performing all of the functions necessary for transporting and planting trees.

A tree which is to be placed at a remote site must first be extracted from the ground with most of the roots left intact. In many cases, the tree must then be loaded onto a truck for transport to the remote site, requiring a tree to be lifted vertically into the bed of the truck. At the planting site, the tree must be lifted out of the truck, and transported to the exact planting location. The tree must then be placed in a planting hole and must finally be set firmly in the hole to prevent tilting during back filling and subsequent settling. A desirable lift attachment must be capable of performing all of these functions. The attachment should be adaptable to farm tractors, skid loaders, and other front-end loader type vehicles commonly associated with nursery work. The attachment should be adjustable for various sizes of trees, as well as for use with rocks and large pots. Finally, the tines of the attachment should be operable to maintain a desired oriented relative to one another as they are either spread apart for larger objects, or brought together for smaller objects.

SUMMARY OF THE INVENTION

It is therefore a general object of the present invention to provide a hydraulic lift attachment for loading vehicles which may be used to plant or transport trees, and which may also be used as a pallet fork for general loading operations.

It is a further object of the present invention to provide a hydraulic lift attachment for loading vehicles which allows an operator to maintain the orientation of tines on the attachment in a predetermined position while spreading or bringing together the tines for various sizes of objects to be lifted.

These and other objects will be apparent to those skilled in the art.

The loader attachment of the present invention includes a frame with a pair of arms pivotally connected thereto and depending therefrom. A tine is pivotally mounted at the lower end of each arm, and projects forwardly from each arm. Hydraulic cylinders are mounted between the frame and the arms to selectively pivot the arms inwardly towards one another and outwardly away from one another. A parallelogram linkage is provided on each arm to maintain the orientation of the tine on the arm as each arm is pivoted. A drive linkage interconnects the two parallelogram linkages such that the tines maintain an orientation relative to one another as the arms are pivoted. A hydraulic cylinder is connected between the frame and the drive linkage to permit selective rotation of the tines in opposing directions on the lower ends of the arms.

DESCRIPTION OF THE PREFERRED EMBODIMENT

Figure 1:
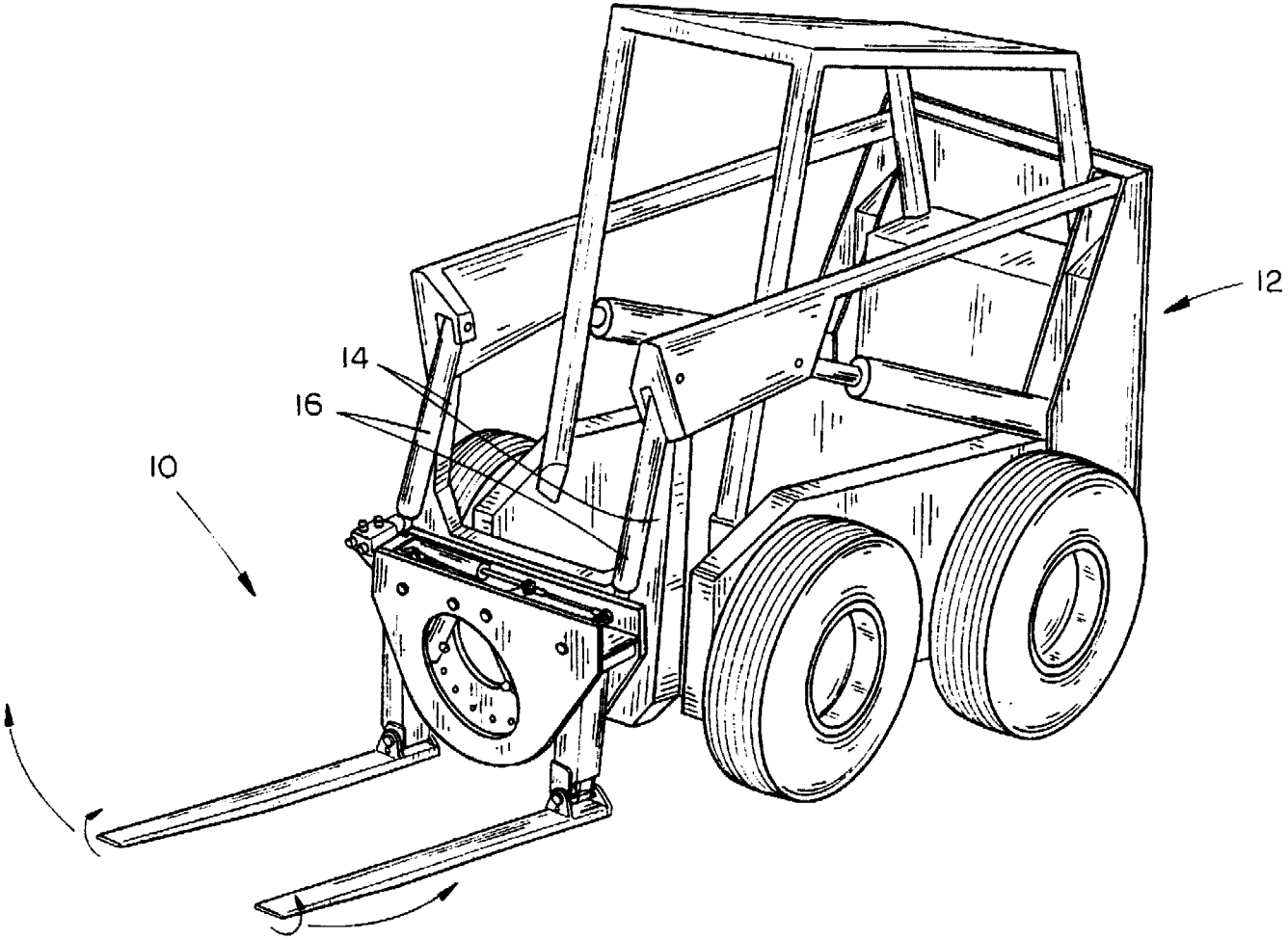
FIG. 1 is a perspective view of the hydraulic lift attachment of the present invention mounted on a loading vehicle.

Referring now to the drawings, in which identical or corresponding parts are identified with the same reference numeral and more particularly to FIG. 1, the hydraulic lift attachment of the present invention is designated generally at 10 and is designed for attachment to a loading vehicle 12, such as a front end loading farm tractor, bucket loader, or skid loader. A common feature of loading vehicles of this type are parallel lift arms 14 for raising and lowering a bucket or other attachment, and control arms 16 for pivoting the attachment to facilitate dumping or other operations.

Figure 2:
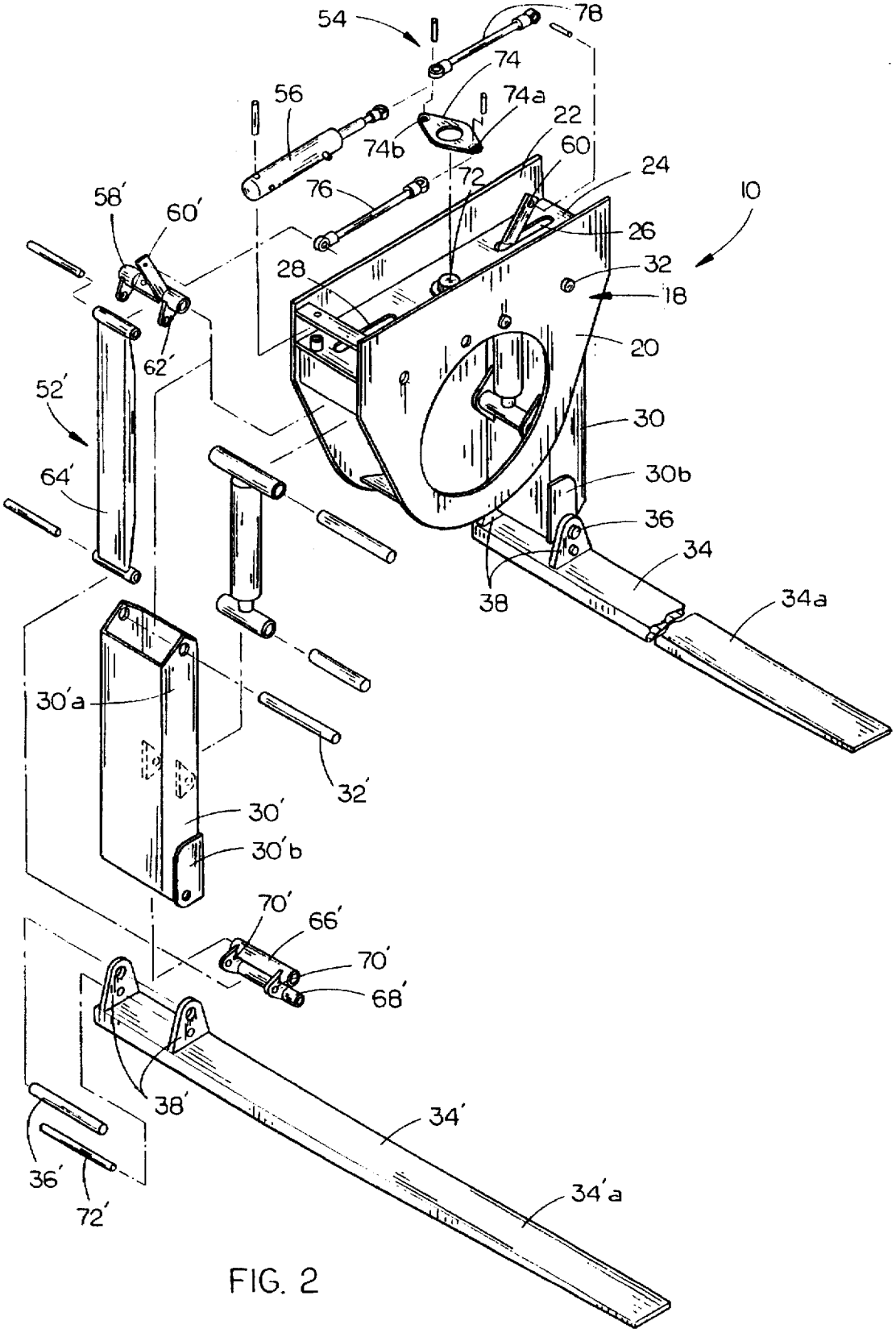
FIG. 2 is a partially exploded perspective view of the hydraulic lift attachment of the present invention.

Referring now to FIG. 2, hydraulic lift attachment 10 includes a frame 18 having a vertically oriented forward plate 20, a rearward plate 22 parallel to forward plate 20, and a transverse base plate 24 interconnecting the upper ends of forward and rearward plates 20 and 22. A pair of elongated slots 26 and 28 are formed in base plate 24 at opposite first and second ends thereof, slots 26 and 28 aligned with one another and oriented parallel and centrally between forward and rearward plates 20 and 22.

Figure 3:
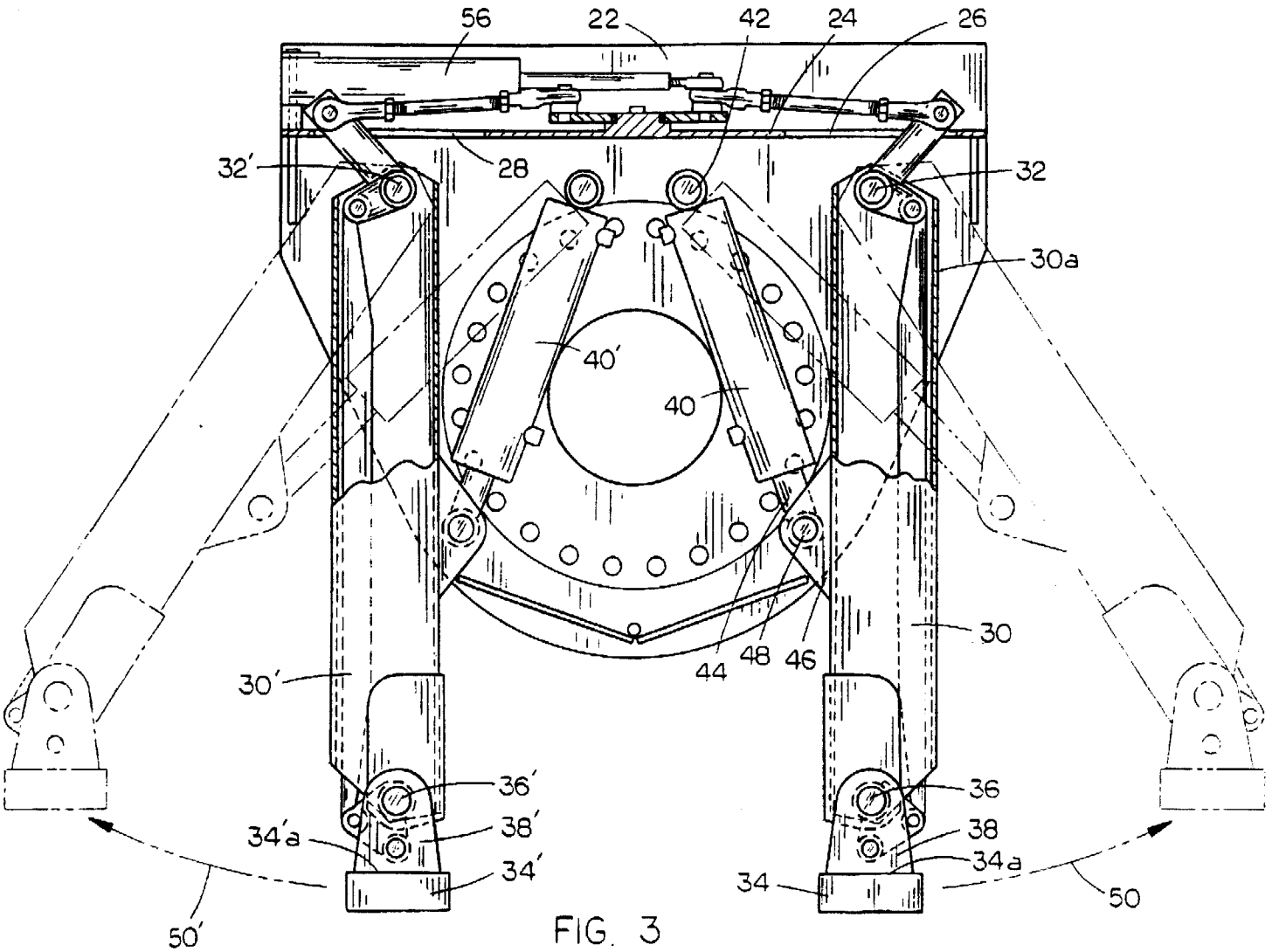
FIG. 3 is a front elevational view of the lift attachment with a broken line view of the tines moved to a spread apart orientation.

Referring now to FIGS. 2 and 3, a first tubular arm 30 is pivotally connected at an upper end **30*a* between forward and rearward plates 20 and 22 by a pivot pin 32 generally centered below and proximal to slot 26. Similarly, a second arm 30' is pivotally connected via pivot pin 32' below slot 28 between forward and rearward plates 20 and 22. A tine 34 is pivotally connected to the lower end 30*b* of arm 30 with a pivot pin 36 extending between a pair of uprights 38 on the rearward end of tine 34, and extending through an aperture in the lower end 30*b* of arm 30. A second tine 34' is pivotally connected via pivot pin 36' to the lower end 30'*b* of arm 30' using uprights 38' on the rearward end of tine 34'**.

As shown in FIG. 3, a hydraulic cylinder 40 is pivotally connected at an upper end between forward and rearward plates 20 and 22 on pin 42. The plunger 44 of cylinder 40 has its lower end pivotally connected to a pair of flanges 46 on arm 30 by a pin 48. All of pins 32, 36, 42 and 48 have parallel axes with pin 48 located intermediate the upper and lower ends of arm 30, and pin 42 located vertically above pin 48, such that extension and retraction of plunger 44 will cause arm 30 to pivot outwardly on pivot pin 32, as shown by arrow 50. Similarly, cylinder 40' will cause arm 30' to pivot about pin 32', as shown by arrow 50'.

Figure 4:
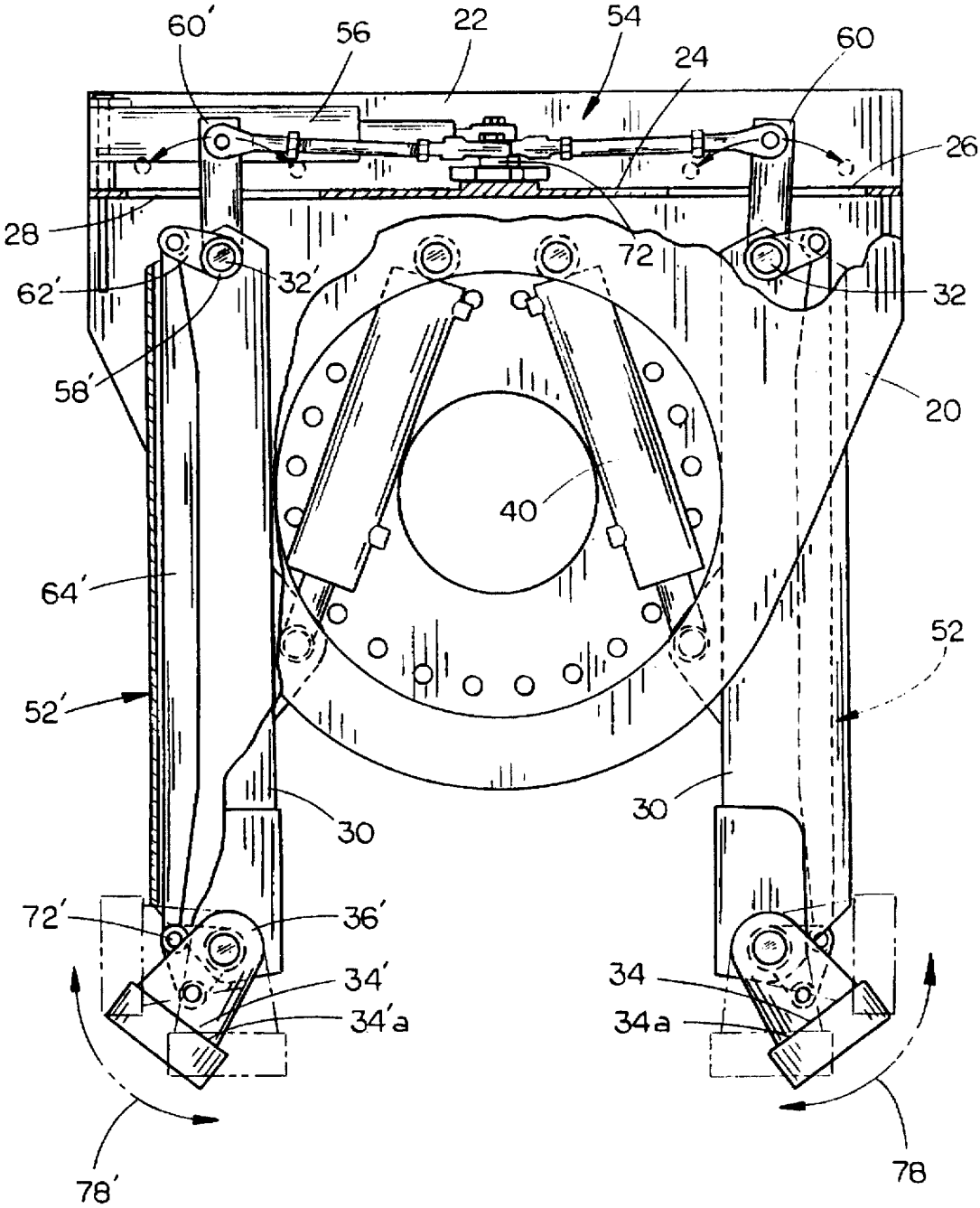
FIG. 4 is a front elevational view of the lift attachment with a broken line view of the tines rotated on parallel axes.

Referring once again to FIG. 2, tines 34 and 34' are preferably elongated, with a flat upper surface 34*a* and 34'*a*, respectively, to act as a pallet fork when tines 34 and 34' are arranged with upper surfaces 34*a* and 34'*a* in co-planar orientation (as shown in FIG. 3). Because hydraulic lift attachment 10 may also be used to lift and transport the root ball of trees of various sizes, it is desirable to provide tines 34 and 34' with an upper surface 34*a* and 34'*a* which may be tilted at an angle relative to the horizontal, as shown in FIG. 4. In order to maintain tines 34 and 34' in a particular orientation relative to one another, throughout the movement of arms 30 and 30' towards and away from one another, parallelogram linkages 52 and 52' are provided on each arm 30 and 30' and are interconnected by a drive linkage 54 and driven by an actuator cylinder 56. Referring now to FIG. 2, parallelogram linkage 52' includes an upper sleeve 58' pivotally mounted on pivot pin 32' at the upper end of arm 30'. A lever 60' is affixed to sleeve 58' and projects upwardly through slot 28 in base plate 24, for connection to drive linkage 54, as described in more detail hereinbelow. A short arm 62' is also affixed to sleeve 58' and is oriented at an angle relative to lever 60'. The upper end of an elongated link 64' is pivotally connected to arm 62'. A lower sleeve 66' is pivotally mounted on pivot pin 36' at the lower end of arm 30', and has a second ancillary sleeve 68' affixed in parallel relation thereto by a pair of flanges 70'. Ancillary sleeve 68' is pivotally connected by a pin 72' to uprights 38', such that movement of flanges 70' will cause tine 34' to pivot about pivot pin 36' within sleeve 66'. The lower end of link 64' is pivotally connected between flanges 70' to thereby link pivotal movement of upper sleeve 58' to lower sleeve 66'. A similar parallelogram linkage 52 links pivotal movement of lever 60 to pivotal movement of tine 34.

As shown in FIGS. 2 and 4, a king pin 72 is mounted generally centrally on the upper surface of base plate 24 and projects upwardly therefrom. A connector plate 74 is rotatably mounted on king pin 72 and has forward and rearward ends 74*a* and 74*b* oriented diametrically about king pin 72. A first link rod 76 is pivotally connected at one end to the forward end 74*a* of connector plate 74, and pivotally connected at the other end to the upper end of lever 60'. A second link rod 78 has one end pivotally connected to connector plate rearward end 74*b*, and the other end pivotally connected to lever 60. In this way, levers 60 and 60' are mechanically linked to move in opposing directions, thereby rotating tines 34 and 34' in opposing directions, as shown by arrows 78 and 78' in FIG. 4.

Figure 5:
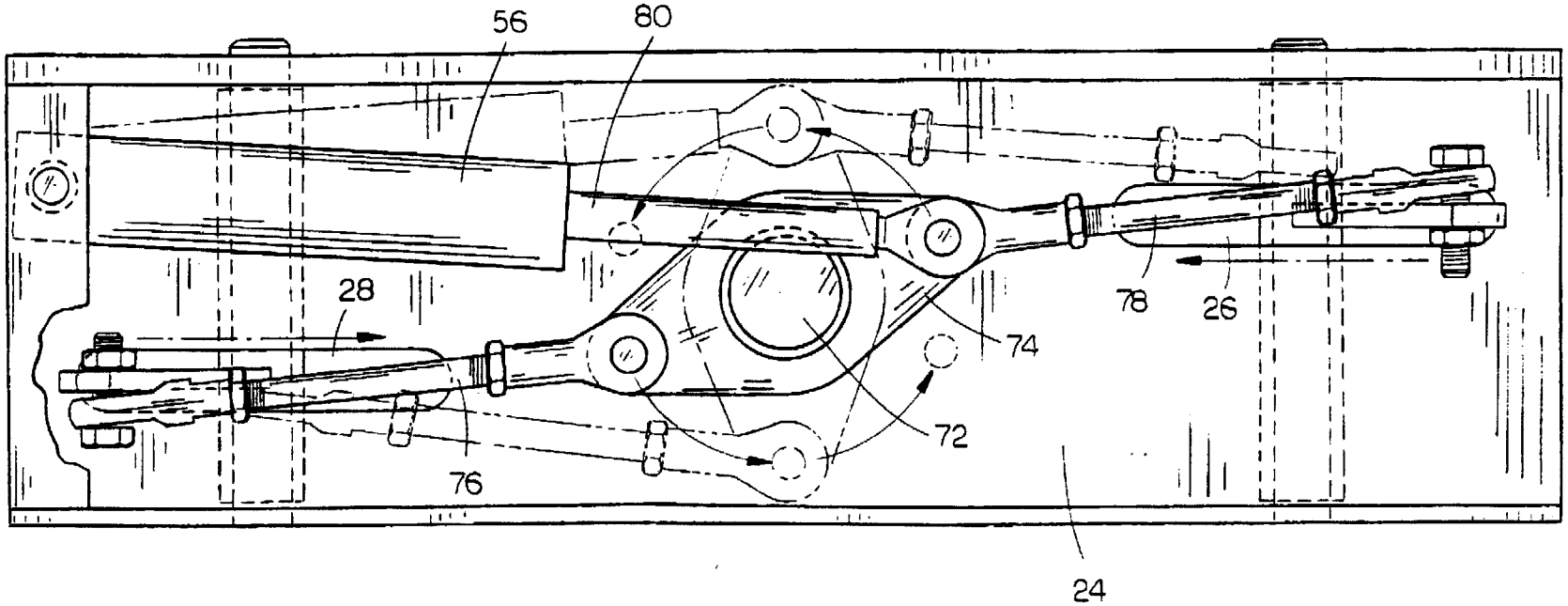
FIG. 5 is a top plan view of the lift attachment.

Referring now to FIG. 5, hydraulic cylinder 56 is pivotally connected at a base end to base plate 24, and has a plunger rod 80 pivotally connected to connector plate 74, such that actuation of cylinder 56 will rotate connector plate 74 either clockwise or counterclockwise on king pin 72. Thus, actuation of cylinder 56 will cause rotation of tines 34 and 34' in proportional amounts in opposing directions. Because parallelogram linkages 52 and 52' connect tines 34 and 34' to arms 30 and 30', the extension and retraction of cylinders 40 and 40', as shown in FIG. 3, will not affect the relative orientations of tines 34 and 34'. In other words, once cylinder 56 is actuated to orient tines 34 and 34' relative to one another, this orientation is maintained throughout movement of arms 30 and 30' by cylinders 40 and 40' (as shown in FIG. 3).

Whereas the invention has been shown and described in connection with the preferred embodiment thereof, many modifications, substitutions and additions may be made which are within the intended broad scope of the appended claims.

I claim:

1. A loader attachment, comprising:

a frame having a forward wall and rearward wall;

a first arm pivotally connected at an upper end to the frame for pivotal movement about a generally horizontal axis oriented in a forward-rearward direction;

a first tine pivotally connected to a lower end of the first arm, for pivotal movement about an axis parallel to the arm upper end pivot axis, said tine projecting forwardly from said first arm;

first means connected between the frame and the first arm, for selectively pivoting said arm about the first arm upper pivot axis, in inward and outward directions;

a second arm pivotally connected at an upper end to the frame for pivotal movement about a pivot axis parallel and spaced apart from the first arm upper pivot axis;

a second tine pivotally connected to a lower end of the third arm, for pivotal movement about an axis parallel to the second arm upper end pivot axis, said second tine projecting forwardly from said second arm;

second means connected between the frame and the second arm, for selectively pivoting said second arm about the second arm upper pivot axis, inwardly towards the first arm and outwardly away from the first arm;

each, said tine including an upper surface;

linkage means connecting said first and second tines, for maintaining selected orientation of the first tine upper surface relative to the second tine upper surface; and an operable actuator connected between said frame and said linkage means, operable to rotate the tines about their respective arm lower pivot axes in opposing rotational directions.

2. The loader attachment of claim 1, wherein said linkage means includes:

a first parallelogram linkage operably connected between the first arm upper pivot axis and the first tine, said first parallelogram linkage includes a first lever connected thereto for rotating the first tine about the first arm lower axis as the first arm pivots about the first arm upper axis;

a second parallelogram linkage operably connected between the second arm upper pivot axis and the second tine, said second parallelogram linkage including a second lever connected thereto for rotating the second tine about the second arm lower axis as the second arm pivots about the second arm upper axis; and a drive linkage operably connecting the levers of the first and second parallelogram linkages, to maintain the tines in the same orientation relative to one another as the first and second arms are pivoted.

3. The loader attachment of claim 2, wherein said drive linkage further comprises:

a connector plate rotatably mounted on a king pin and located intermediate said first and second levers;

said connector plate having first and second ends oriented diametrically about the king pin;

a first rod connecting the first lever to the connector plate first end; and a second rod connecting the second lever to the connector plate second end.

4. A loader attachment, comprising:

a frame having a forward wall and rearward wall;

a first arm pivotally connected at an upper end to the frame for pivotal movement about a generally horizontal axis oriented in a forward-rearward direction;

a first tine pivotally connected to a lower end of the first arm, for pivotal movement about an axis parallel to the arm upper end pivot axis, said tine projecting forwardly from said first arm;

first means connected between the frame and the first arm, for selectively pivoting said arm about the first arm upper pivot axis, in inward and outward directions;

a second arm connected at an upper end to the frame for pivotal movement about a pivot axis parallel and spaced apart from the first arm upper pivot axis;

a second tine pivotally to a lower end of the third arm, for pivotal movement about an axis parallel to the second arm upper end pivot axis, said second tine projecting forwardly from said second arm;

second means connected between the frame and the second arm, for selectively pivoting said second arm about the second arm upper pivot axis, inwardly towards the first arm and outwardly away from the first arm;

each said tine including an upper surface;

linkage means connecting said first and second tines, for maintaining selected orientation of the first tine upper surface relative to the second tine upper surface, said linkage means including;

a first parallelogram linkage operably connected between the first arm upper pivot axis and the first tine, said first parallelogram linkage includes a first lever connected thereto for rotating the first tine about the first arm lower axis as the first arm pivots about the first arm upper axis;

a second parallelogram linkage connected between the second arm upper pivot axis and the second tine, said second parallelogram linkage including a second lever connected thereto for rotating the second tine about the second arm lower axis as the second arm pivots about the second arm upper axis; and a drive linkage operably connecting the levers of the first and second parallelogram linkages, to maintain the tines in the same orientation relative to one another as the first and second arms are pivoted;

said drive linkage comprising:

a connector plate rotatably mounted on a king pin and located intermediate said first and second levers;

said connector plate having first and second ends oriented diametrically about the king pin;

a first rod connecting the first lever to the connector plate first end; and a second rod connecting the second lever to the connector plate second end; and an operable actuator connected between the frame and the connector plate, operable to rotate the connector plate on the king pin.

5. The loader attachment of claim 4, wherein said linkage means includes:

a first parallelogram linkage operably connected between the first arm upper pivot axis and the first tine, said first parallelogram linkage includes a first lever connected thereto for rotating the first tine about the first arm lower axis as the first arm pivots about the first arm upper axis;

a second parallelogram linkage operably connected between the second arm upper pivot axis and the second tine, said second parallelogram linkage including a second lever connected thereto for rotating the second tine about the second arm lower axis as the second arm pivots about the second arm upper axis; and a drive linkage operably connecting the levers of the first and second parallelogram linkages, to maintain the tines in the same orientation relative to one another as the first and second arms are pivoted.

6. The loader attachment of claim 5, wherein said drive linkage further comprises:

a connector plate rotatably mounted on a king pin and located intermediate said first and second levers;

said connector plate having first and second ends oriented diametrically about the king pin;

a first rod connecting the first lever to the connector plate first end; and a second rod connecting the second lever to the connector plate second end.

7. The loader attachment of claim 6, further comprising an operable actuator connected between the frame and the connector plate, operable to rotate the connector plate on the king pin.

* * * * *